US005085054A

United States Patent [19]

Katsuda et al.

[11] Patent Number: 5,085,054

[45] Date of Patent: Feb. 4, 1992

[54] SEALING MECHANISM IN STIRLING ENGINE

[75] Inventors: Hiroyuki Katsuda, Okazaki; Tomokimi Mizuno, Chiryu; Tetsumi Watanabe, Okazaki, all of Japan

[73] Assignee: Aisin Seiki Kabushiki Kaisha, Kariya, Japan

[21] Appl. No.: 608,820

[22] Filed: Nov. 5, 1990

[30] Foreign Application Priority Data

Nov. 7, 1989 [JP] Japan ..... 1-289393

[51] Int. Cl.[5] ..... F02G 1/04

[52] U.S. Cl. ..... 60/517

[58] Field of Search ..... 60/517, 521, 522, 525, 60/526

[56] References Cited

U.S. PATENT DOCUMENTS 3,812,677 5/1974 Gries ..... 60/517
3,848,877 11/1974 Bengtsson et al. ..... 60/517
4,452,042 6/1984 Lindskoug ..... 60/517
4,483,141 11/1984 Kobayashi et al. ..... 60/517

*Primary Examiner*—Allen M. Ostrager
*Attorney, Agent, or Firm*—Burns, Doane, Swecker & Mathis

[57] ABSTRACT

A sealing mechanism in a Stirling engine comprising, an output deriving device, a rod for connecting an operating piston defining an operating space and the output deriving device, an intermediate member for supporting the rod in fluid-tight manner via a bush, a sealing member secured to the intermediate member and including a lip in elastic engagement with the rod for assuring a fluid-tight fit, an intermediate chamber defined between the sealing member and the operating piston, a pressure chamber defined between the sealing member and the intermediate member, a first check-valve allowing fluid-flow from the intermediate chamber to the pressure chamber and a relief valve to be opened for releasing the pressure in the pressure chamber into a space for accommodating the output deriving device when the differential pressure exceeds a predetermined value.

4 Claims, 2 Drawing Sheets

SEALING MECHANISM IN STIRLING ENGINE

BACKGROUND OF THE INVENTION

1. Field of the Invention

The present invention relates to a sealing mechanism in a Stirling engine and in particular to a sealing mechanism for preventing the invasion of operating fluid into an operating space in a Stirling engine.

2. Description of the Prior Art

A conventional sealing mechanism in a Stirling engine is shown, for example, in Japanese Patent Laid-open Print No. 64-87854 published on Mar. 31, 1989 without examination. The conventional sealing mechanism, which is served for preventing oil-invasion from a crank chamber to a back-space of a piston, includes a first seal member positioned at a side of the crank chamber and a second seal member positioned at a side of the piston. With respect to the first seal member, a sealing ability against the fluid-flow from the crank chamber to the back-space is superior to the counter fluid-flow. With respect to the second seal member, a sealing abilities are contrary or reversed to those of the first seal member. A space is defined between both seal members and is kept at a pressure which equals the minimum pressure of the back-space.

However, the conventional sealing mechanism has drawbacks as detailed hereinbelow. That is to say, an amount of oil corresponding to its oil-thickness on the piston are remained thereon and are moved toward the second seal member. In light of the foregoing abilities of the second seal member, unless the distance between both seal members is set to be greater than the stroke of the piston, the oil is moved into the back-space when the piston is in its upper dead-point. The resulting oil is scraped into the back-space by the second seal member when the piston is moved toward its lower dead-point. This phenomenon is called as the pumping-up phenomenon. In order to prevent the pumping-up phenomenon, the distance between both seal members has to be extended or enlarged. This means the enlargement of the Stirling engine.

In addition, since the space defined between both seal members is kept at a pressure of the minimum pressure of the pressure-variation in the back-space, if the Stirling engine is driven under its minimum-pressure to its maximum, excess pressures are applied to the seal members, thereby weaking the durability of each seal member and increasing the sliding friction between the piston and each seal member.

SUMMARY OF THE INVENTION

It is, therefore, a principal object of the present invention to provide a sealing mechanism in a Stirling engine without the foregoing drawbacks.

Another object of the present invention is to provide a sealing mechanism in a Stirling engine which can prevent the oil-invasion without damaging the seal members and enlargement of the engine itself.

In order to attain the foregoing objects, a sealing mechanism in a Stirling engine according to the present invention is comprised of an output deriving means, a rod for connecting an operating piston defining an operating space and the output deriving means, an intermediate member for supporting the rod in fluid-tight manner via a bush, a sealing member secured to the intermediate member and including a lip in elastic engagement with the rod for assuring a fluid-tight fit therebetween, an intermediate chamber defined between the sealing member and the operating piston, a pressure chamber defined between the sealing member and the intermediate member, a first check valve allowing fluid-flow from the intermediate chamber to the pressure chamber and provided therebetween, and a relief valve to be opened for releasing the pressure in the pressure chamber into a space for accommodating the output deriving means when the differential pressure therebetween exceeds a set value.

DETAILED DESCRIPTION OF THE PREFERRED EMBODIMENTS

Figure 1:
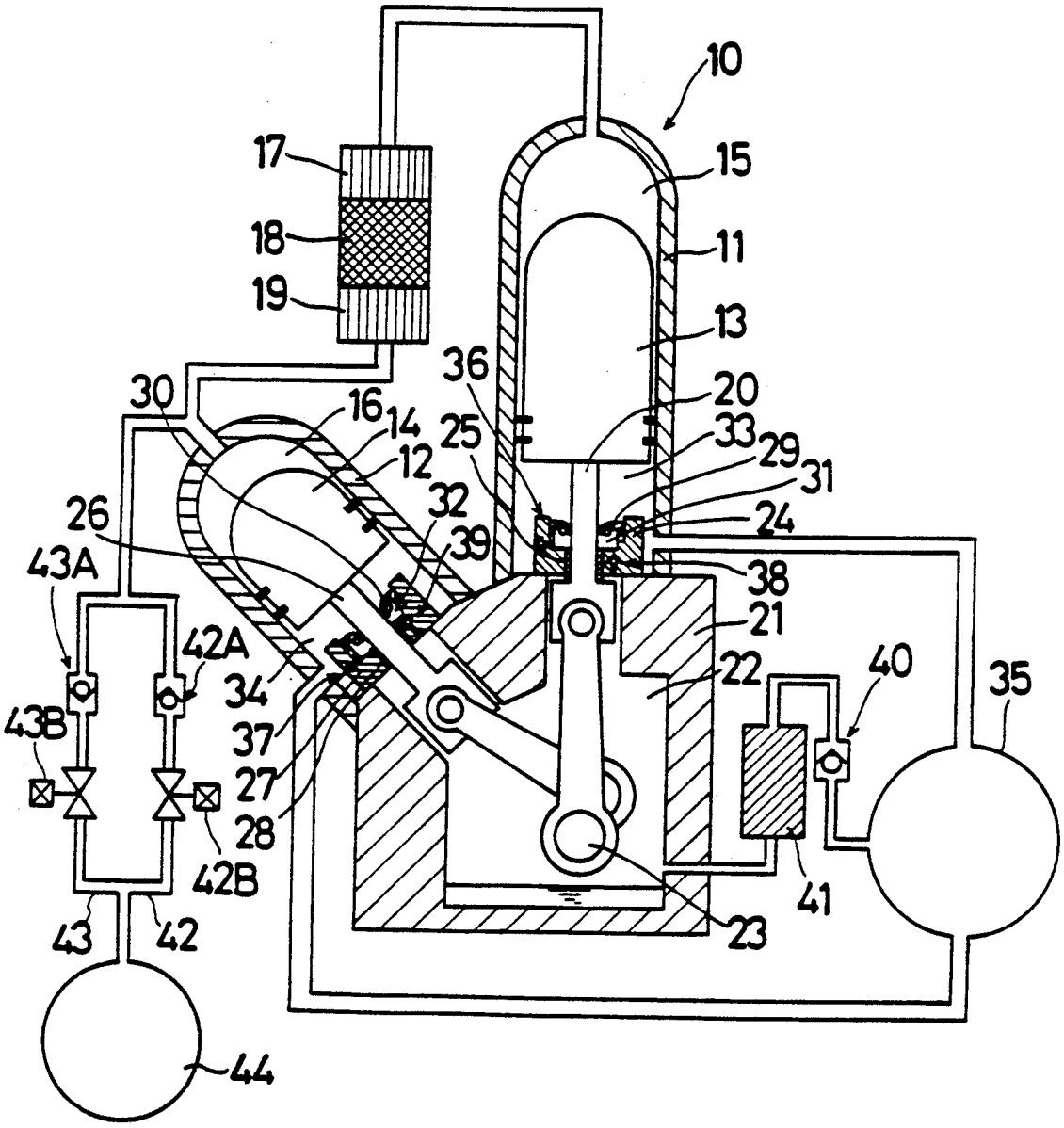
FIG. 1 shows a cross-sectional view of one embodiment of a sealing mechanism in a Stirling engine according to the present invention.

Referring first to FIG. 1, a Stirling engine 10 includes an expansion cylinder 11 in which an expansion piston 13 is slidably fitted in a fluid-tight manner and a compression cylinder 12 in which a compression piston 14 is slidably fitted in a fluid-tight manner. The expansion piston 13 defines an expansion chamber 15 within the expansion cylinder 11. Similarly, the compression piston 14 defines a compression chamber 16 within a compression cylinder 12. Both chambers 15 and 16 constitute an operating space (not numbered).

The expansion chamber 15 is in fluid communication with the compression chamber 16 via a heater 17, a heat-storage element or a generator 18 and a radiator 19. Within the operating space which is formed into a sealed or closed configuration, an amount of He-gas is stored as an operating fluid.

The expansion piston 13 is operatively connected, via a rod 20, to a crank-shaft 23 which is accommodated within a crank chamber 22 defined in a crank-case 21. A vibration of the rod 20 (the expansion piston 13) which makes an angle with respect its axis is regulated by a bush or bearing 25 through which the rod 20 is slidingly passed. The bush 25 is provided at an inner periphery of an intermediate member 24 which is disposed between the crank case 21 and a back-side of the expansion piston 13. Similar to the expansion piston 13, the compression piston 14 is operatively connected, via a rod 26, to the crank-shaft 23 and the vibration of the rod 26 is regulated by a bush 28 provided at an intermediate member 27 which is disposed between the crank case 21 and a back-side of the compression piston 14. Thus, according to the rotation of the crank-shaft 23, both pistons 13 and 14 move reciprocably in respective cylinders 11 and 12. The expansion piston 13 is set to be advanced at an angle with respect to the compression piston 14.

The compression chamber 16 is connected to a pressure tank 44 via a maximum-pressure line 42 having a one-way valve **42*a* and a reducing valve 42*b* and a minimum-pressure line 43 which is arranged in parallel with the maximum-pressure line 42 and has a one-way valve 43*a* and an increasing valve 43*b*. The one-way valve 42*a* is designed to allow the fluid-flow from the compression chamber 14 to the tank 44 but prevent the reverse fluid-flow. The one-way valve 43*a* is designed to be contrary to the one-way valve 42***a*. Thus, upon opening of the reducing valve 42*b*, pressure in the operating space is flowed into the tank 44, thereby decreasing the average pressure of the operating fluid and an output of the engine 10. Similarly, opening the increasing valve 43*a* allows pressure in the tank 44 to be supplied to the operating space, thereby increasing the average pressure of the operating fluid and the output of the engine 10.

Figure 2:
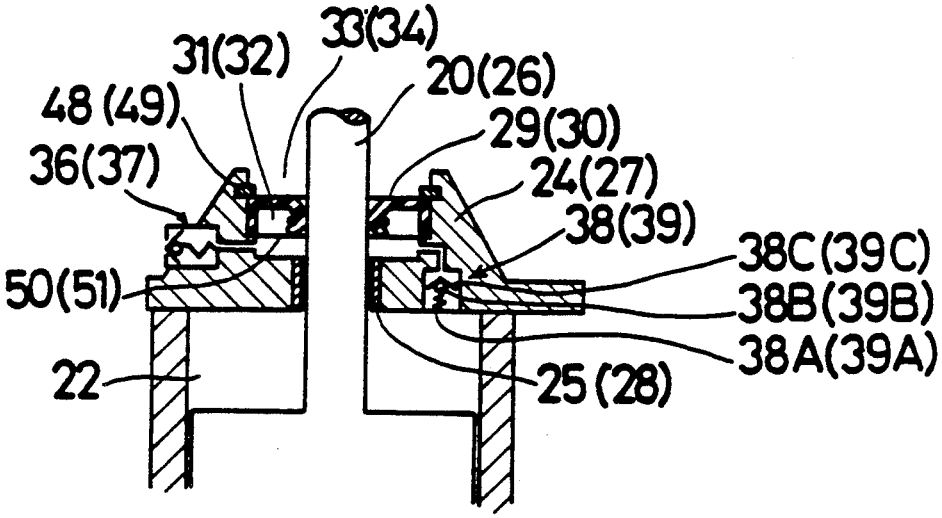
FIG. 2 shows an enlarged view of a main portion of a sealing mechanism shown in FIG. 1.

A sealing member or oil-scraper 29 (30) is held in the intermediate member 24 (27) and is in sliding and fluid-tightly engagement with the rod 20 (26). Thus, a pressure chamber 31 (32) is defined between the 'sealing member 29 (30) and the bush 25 (28) within intermediate member 24 (27). An intermediate chamber 33 (34) is also defined between a back-side of the expansion piston 13 (the compression piston 14) and the sealing member 29 (30). As shown in FIG. 2, the sealing member 29 (30) is held between a a lower inward projection of the intermediate member 24 (27) and a ring 48 (49) secured to an upper portion thereof. Thus, the axial movement of the sealing member 29 (30) is prevented. A lip portion of the sealing member 29 (30) is continually urged by a spring 50 (51) having a load toward the rod 20 (26). In this embodiment, the intermediate chambers 33 and 34 are in fluid communication each other via a buffer tank 35.

A first check-valve 36 (37) is so provided or accommodated in the intermediate member 24 (27) as to allow the fluid-flow from the intermediate chamber 33 (34) to the pressure chamber 31 (32) and prevent contrary flow. As soon as the pressure in the intermediate chamber 33 (34) becomes greater than that in the pressure chamber 31 (32), the first check-valve 36 (37) introduces the pressure in the intermediate chamber 33 (34) into the pressure chamber 31 (32) for regulating the pressure in the intermediate chamber 33 (34) at equal or smaller than that in the pressure chamber 31 (32) This means that the pressure in the pressure chamber 31 (32) is set at the maximum pressure of the pressure in the intermediate chamber 33 (34) which varies in accordance wit the reciprocally moving piston 13 (14).

A relief valve 38 (39) is provided in the intermediate member 24 (27) and is designed to be opened when a differential pressure between the pressure chamber 31 (32) and the crank chamber 22 exceeds a set value, for releasing the pressure from the pressure chamber 31 (32) to the crank chamber 22. The relief valve 38 939) has a valve member 38*b* (39*b*) which is urged continually toward a valve seat 38*c* (39*c*) at a side of the pressure chamber 31 (32) by a spring 38*a* (39*a*) with a load. When the pressure in the pressure chamber 31 (32) exceeds the summation of the pressure in the crank chamber 22 and the load of the spring 38*a* (39*a*), valve 38 (39) opens and the pressure int h chamber 31 is reduced to the summation of the crank chamber 22 pressure and the spring load.

In this embodiment, a second check-valve 40, which is connected to the buffer tank 35, is connected to the crank chamber 22 via a filter 41 in such a manner that fluid-flow is prevented from the buffer tank 35 to the crank chamber 22 and is allowed in the reverse direction or from the crank chamber 22 to the buffer tank 35. Thus, the pressure in the crank chamber 22 is set to be the minimum pressure in the intermediate chamber 33 (34) which varies in accordance with the reciprocal movement of the piston 13 (14). In addition, the load of spring 38*a* (39*a*) of the relief valve 38 (39) is so set as to open the valve 38 (39) when the differential pressure between the crank chamber 22 and the pressure chamber 31 (32) exceeds the differential or ranging pressure between the maximum and the minimum pressures in the intermediate chamber 33 (34) when the engine 10 operates at its maximum output.

Figure 3:
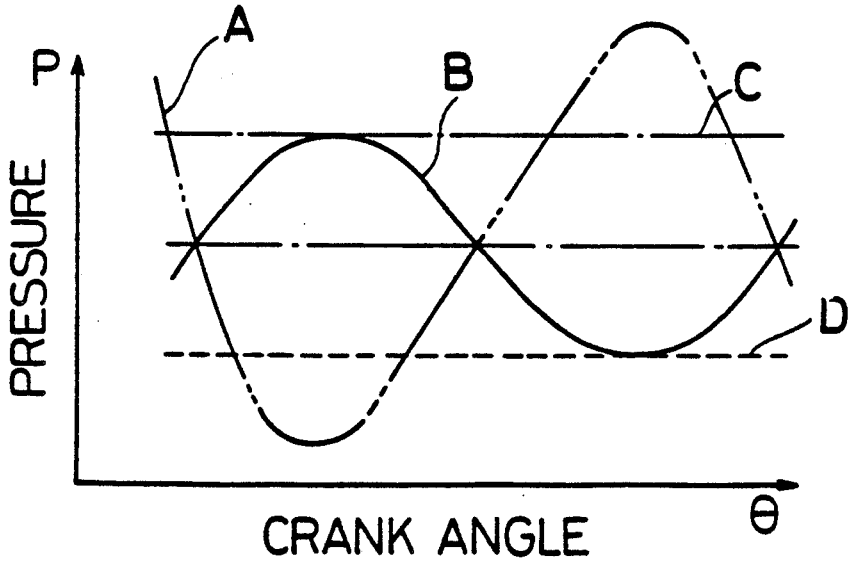
FIG. 3 shows a graph showing the pressure-change in each chamber in a Stirling engine.

In operation, when the pistons 13 and 14 are brought into reciprocal movement as a result of the rotation of the crank-shaft 23, due to the functions of the heater 17, the generator 18 and the radiator 19, the pressure of the operating fluid within the operating space traces a curve indicated with 'A' in FIG. 3, thereby beginning a stable or independent operation or running of the engine 10 and enabling the delivering of an output of power therefrom.

The pressure in the intermediate chamber 33 (34) begins to vary as indicated by 'B' in FIG. 3 as the engine operates. Due to the resulting pressure-variation in the intermediate chamber 33 (34), the lip of sealing member 29 (30) is subject to deformation in the direction of the permission of oil-entrance from the crank chamber 22 into the intermediate chamber 33 (34). However, in this embodiment, due to the actuation of the first check-valve 36 (37), the pressure in the pressure chamber 31 (32), as indicated by 'C' in FIG. 3, is kept at the maximum pressure in the intermediate chamber 33 (34). Thus, the pressure in the pressure chamber 31 (32) is equal to or greater than the pressure in the intermediate chamber 33 (34). In other words, the urging force applied on the lip of the sealing member 29 (30) for establishing fluid-tight engagement between the sealing member 29 (30) and the rod 20 (26) can become equal to or greater than the load of the spring 50 (51). Thus, the entrance or invasion of oil from the crank chamber 22 to the intermediate chamber 33 (34) is prevented without resort to the prior art scaling up of the engine 10.

In the Stirling engine 10 as described above, the output power depends on the average pressure within the operating space, which is controlled by establishing fluid communication between the pressure tank 44 and the operating space via alternation of the maximum-pressure line 42 and the minimum-pressure line 43. The changing of the average pressure in the operating space varies the average pressure in the intermediate chamber 33 (34). If the output is decreased to the minimum after the Stirling engine 10 has been driven at a maximum pressure for obtaining the maximum output, the pressure in intermediate chamber 33 (34) is dropped though the pressure in the pressure chamber 31 (32) is kept at a value which equals to the maximum pressure in the intermediate chamber 33 (34) under the foregoing maximum-output operation of the engine 10. Thus, an excess force may be applied to the sealing member 29 (30), thereby decreasing the durability thereof. To solve this potential problem, in this embodiment, as indicated with 'D' in FIG. 3, the pressure in the crank chamber 22 is kept at a value which equals the minimum pressure in the intermediate chamber 33 (34) as a result the actuation of the second check-valve 40 and the pressure in the pressure chamber 31 (32) is released to the crank chamber 22 due to the opening of the relief valve 38 (39) when the differential pressure between the crank chamber 22 and the pressure chamber 31 (32) (hereinafter referred as the pressure 'X') exceeds the differential or ranging pressure between the maximum and the minimum pressures in the intermediate chamber 33 (34) (hereinafter referred as the pressure 'Y') while the engine 10 is its maximum output operation. Thus, upon the occurrence of the foregoing situation, the relief valve 38

(39) is opened and the pressure in the pressure chamber 31 (32) is released to the crank chamber 22 with the result that the pressure 'X' can become less than the pressure 'Y'.

Therefore, the invasion of oil into the operating space can be prevented in such a manner that excess force is not applied to the sealing member 29 (30) by assuring that the pressure in the pressure chamber 31 (32) greater than the pressure in the intermediate chamber 33 (34). It is noted that oil scraped by the lip of the sealing member 29 (30) in the pressure chamber 31 (32) is returned, together with the pressure or the operating fluid, to the crank chamber 22 through the relief valve 38 (39).

In this embodiment, since the pressure in the crank chamber 22 is always kept at the minimum pressure in the intermediate chamber 33 (34) by the second check-valve 40, crank case 21 is not required to be of high strength, thereby enabling the construction thereof with thin metal. This leads to the miniaturization of the Stirling engine 1 itself.

Instead of the above-mentioned opening manner, the relief valve 38 (39) can be opened by another method as follows. The pressure in the crank chamber 22 is always kept at the average pressure in the operating space or the intermediate chamber 33 (34) by connecting the crank chamber 22 and the operating space or the intermediate chamber 33 (34) via an orifice (not shown). When the pressure in the crank chamber 22 exceeds the differential pressure between the maximum pressures in the intermediate chamber 33 (34) and the average pressure in the operating space or the intermediate chamber 33 ( the average pressure in the operating space or the intermediate chamber 34), the pressure in the pressure chamber 31 (32) is drained into the crank chamber 22.

According to another embodiment or the modification, similar to the embodiment of this invention previously described, the first check-valve 36 (37) keep the pressure in the pressure chamber 33 (34) at a value which equals the maximum pressure in the intermediate chamber 33 (34), thereby maintaining the pressure in the pressure chamber 31 (32) equal to or greater than the pressure in the intermediate chamber 33 (34). Thus, oil-invasion from the crank chamber 21 into the intermediate chamber 33 (34) can be prevented without the scaling-up of the Stirling engine 10.

It is noted that either of the expansion piston 13 and the compression piston 14 is referred as an operating piston.

Obviously, numerous modifications and variations of the present invention are possible in light of the above teachings. It is therefore to be understood that within the scope of the appended claims, the invention may be practiced otherwise than as specifically described herein.

What is claimed is:

1. A sealing mechanism win a Stirling engine comprising:

an output deriving means;

a rod for connecting an operating piston defining an operating space and the output deriving means;

an intermediate member for supporting the rod in fluid-tight manner via a bush;

a sealing member secured to the intermediate member and including a lip in elastic engagement with the rod for assuring a fluid-tight fit therebetween;

an intermediate chamber defined between the sealing member and the operating piston;

a pressure chamber defined between the saling member and the intermediate member;

a first check-valve allowing fluid-flow from the intermediate chamber to the pressure chamber and provided therebetween; and a relief valve to be opened for releasing the pressure in the pressure chamber into a space for accommodating the output deriving means when the differential pressure therebetween exceeds a set value.

2. A sealing mechanism according to claim 1, further including a a second check-vale for allowing the fluid-flow from the space to the intermediate chamber so as to define the set value as a differential pressure between the maxim and the minimum pressures in the intermediate chamber while the engine is driven at a maximum rate.

3. A sealing mechanism according to claim 1 further including an orifice for connecting the space to the operating space so as to define the set value as a differential value between the maximum pressure in the intermediate chamber and the average pressure in the operating space.

4. A sealing mechanism according o claim 1 further including an orifice for connecting the space to the intermediate chamber so as to define the set value as a differential value between the maximum pressure in the intermediate chamber and the average pressure in the ting space.

* * * * *